US011260269B2

(12) United States Patent
Granlund et al.

(10) Patent No.: US 11,260,269 B2
(45) Date of Patent: Mar. 1, 2022

(54) EXERCISE APPARATUS

(71) Applicant: Ab Hur Oy, Kokkola (FI)

(72) Inventors: Tommy Granlund, Kokkola (FI); Ville Juuti, Kokkola (FI); Mats Manderbacka, Kokkola (FI); Taneli Peltoniemi, Kokkola (FI)

(73) Assignee: Ab Hur Oy, Kokkola (FI)

( * ) Notice: Subject to any disclaimer, the term of this patent is extended or adjusted under 35 U.S.C. 154(b) by 317 days.

(21) Appl. No.: 16/672,597

(22) Filed: Nov. 4, 2019

(65) Prior Publication Data

US 2020/0147452 A1 May 14, 2020

(30) Foreign Application Priority Data

Nov. 9, 2018 (FI) ..... 20185954

(51) Int. Cl.
*A63B 24/00* (2006.01)
*A63B 21/008* (2006.01)
(Continued)

(52) U.S. Cl.
CPC ..... *A63B 24/0062* (2013.01); *A63B 21/0087* (2013.01); *A63B 21/159* (2013.01);
(Continued)

(58) Field of Classification Search
None
See application file for complete search history.

(56) References Cited

U.S. PATENT DOCUMENTS 4,063,726 A * 12/1977 Wilson ..... A63B 21/00178 482/5
4,722,525 A * 2/1988 Brentham ..... A63B 21/0083 482/113
(Continued)

FOREIGN PATENT DOCUMENTS

DE 10 2005 054566 A1 5/2007
EP 3 650 085 A1 5/2020
(Continued)

OTHER PUBLICATIONS

Opinion on Patentability issued by the Patent and Registration Office of Finland in relation to corresponding Finnish Application No. 20185954 dated Mar. 29, 2019, 4 pgs.
(Continued)

*Primary Examiner* — Sundhara M Ganesan
*Assistant Examiner* — Shila Jalalzadeh Abyaneh
(74) *Attorney, Agent, or Firm* — FisherBroyles, LLP

(57) ABSTRACT

An apparatus for an exercise task includes a pneumatic arrangement, which includes a pressure source, a pneumatic controller, pneumatic transfer channels, and at least one pneumatic resistor element, which includes a pneumatic cylinder with its piston. The apparatus additionally includes a mechanical lever arm structure or another mechanical connecting structure, which is for a user's limb contact and which is at a second end connected to the pneumatic resistor element. The apparatus additionally includes a sensor structure, a calculation arrangement and a display. The sensor structure is arranged to measure at least one measurement quantity of the exercise task and, based on the measurement, the calculation arrangement is arranged to form information on the display of the apparatus, regarding the power and/or force and/or range of motion of the exercise task. In the invention, regardless of the number of pneumatic resistor elements, the sensor structure includes one pressure sensor
(Continued)

only, and to compensate for the small number of sensors, the calculation arrangement includes a correlation-taught calculation unit, which comprises a correlation algorithm taught with a larger number of sensors than the number of sensors in the apparatus, concerning the correlation between power and/or force and/or range of motion of the exercise task and the measured information.

7 Claims, 6 Drawing Sheets

(51) Int. Cl.
*A63B 21/00* (2006.01)
*A63B 71/06* (2006.01)

(52) U.S. Cl.
CPC .. *A63B 71/0622* (2013.01); *A63B 2024/0093* (2013.01); *A63B 2220/56* (2013.01); *A63B 2220/803* (2013.01); *A63B 2220/833* (2013.01)

(56) References Cited

U.S. PATENT DOCUMENTS 4,846,466 A * 7/1989 Stima, III ..... A63B 23/03516 482/112
5,312,315 A * 5/1994 Mortensen ..... A63B 21/0087 482/113
5,890,996 A * 4/1999 Frame ..... A63B 22/0007 482/8
2004/0250618 A1* 12/2004 Keiser ..... A61B 5/224 73/379.09
2005/0233874 A1* 10/2005 Bucay-Bissu .... A63B 21/00072 482/112
2007/0054788 A1* 3/2007 Johnston ..... A63B 21/155 482/97
2010/0311552 A1* 12/2010 Sumners ..... A63B 21/0087 482/111
2018/0243600 A1 8/2018 Kennington
2018/0275629 A1 9/2018 Watanabe

FOREIGN PATENT DOCUMENTS

GB 2562121 A 11/2018
KR 101384170 B1 4/2014
KR 10-1794094 B1 11/2017
WO 97/45168 A1 12/1997
WO 2004/087262 A2 10/2004

OTHER PUBLICATIONS

Research Report issued by the Patent and Registration Office of Finland in relation to corresponding Finnish Application No. 20185954 dated Mar. 29, 2019, 2 pgs.
Extended European Search Report received for European Application No. 19207018.3 dated Mar. 31, 2020, 8 pages.

* cited by examiner

EXERCISE APPARATUS

CROSS-REFERENCE TO RELATED APPLICATION

This application claims benefit and priority to Finnish Application No. 20185954, filed Nov. 9, 2018, which is incorporated by reference herein in its entirety.

BACKGROUND

Field

The area of application of the present invention is an apparatus for an exercise task, in other words, an apparatus for establishing physical stress. The apparatus may be a fitness apparatus or a rehabilitation apparatus. Such apparatuses may be used at gyms, medical care institutions, and home.

Description of the Related Art

With apparatuses meant for exercising or rehabilitation, resistance is formed for limb motions that a user is making, the magnitude of the resistance being adjustable to suit the user and the exercise program concerned.

To form the resistance, addable weights have conventionally been used, but pneumatic resistance elements, too, are known, such as apparatuses using pneumatic cylinders, because with the aid of a pneumatic resistance element it is possible to make the magnitude of the resistance less dependent on the speed of the motion performed.

The present invention relates to apparatuses that use pneumatic resistance elements. In such apparatus, between a user and the pneumatic cylinder there is a mechanical articulated arm structure i.e. a lever arm structure, which on the pneumatic cylinder side is connected to an outer end of a piston rod protruding from the pneumatic cylinder. The pneumatic cylinder with its piston may be considered an internal subarrangement in the apparatus, and the articulated arm structure may be considered an external subarrangement in the apparatus.

In fitness and rehabilitation apparatuses there is additionally the need to measure the operation of the apparatus during a movement task made by a user. It is of particular interest to find out the force, power, and range of motion of the motion, and for this purpose sensors are used which measure, as concerns the internal subarrangement i.e. the pneumatic cylinder, the pressure and the speed of motion of the piston, and as concerns the external arrangement i.e. the articulated arm structure, the speed of motion is measured. The information revealed by the measurements, so information on force, power, and range of motion, may be used to control the operation of the apparatus, in other words to adjust the pneumatic cylinders to produce a suitable resistance, and in addition the information that was found out may be used to present the information on a display device to a user, or a person assisting or monitoring the user.

In known apparatuses, sensors are extensively used in which a pressure sensor on both sides of the piston need to be used for the internal subarrangement i.e. the pneumatic cylinder. For an apparatus provided with two pneumatic cylinders, for example, this means as many as four pressure sensors. Known apparatuses additionally make use of a motion sensor for measuring the external subarrangement i.e. the articulated arm structure.

It is an object of the present invention to reduce or obviate problems related to the known solutions.

SUMMARY

An object of the invention is thus to provide an apparatus that solves the aforementioned problems. The object of the invention is reached by the apparatus according to the invention, which is characterized by what is stated in the characterizing part of independent claim 1. Preferred embodiments of the invention are disclosed in the dependent claims.

The invention provides considerable advantages. The quantity of measuring sensors may be reduced whereby a structure is achieved which is smaller in size and more reliable, as well as cost savings relating to the actual sensors, and the fastening structures of the sensors as well as peripheral electronics needed by the sensors, which as stated in the above are required to a lesser degree than previously.

BRIEF DESCRIPTION OF THE FIGURES

The invention will now be described in more detail in connection with preferred embodiments and with reference to the accompanying drawings, in which.

DETAILED DESCRIPTION

Figure 1:
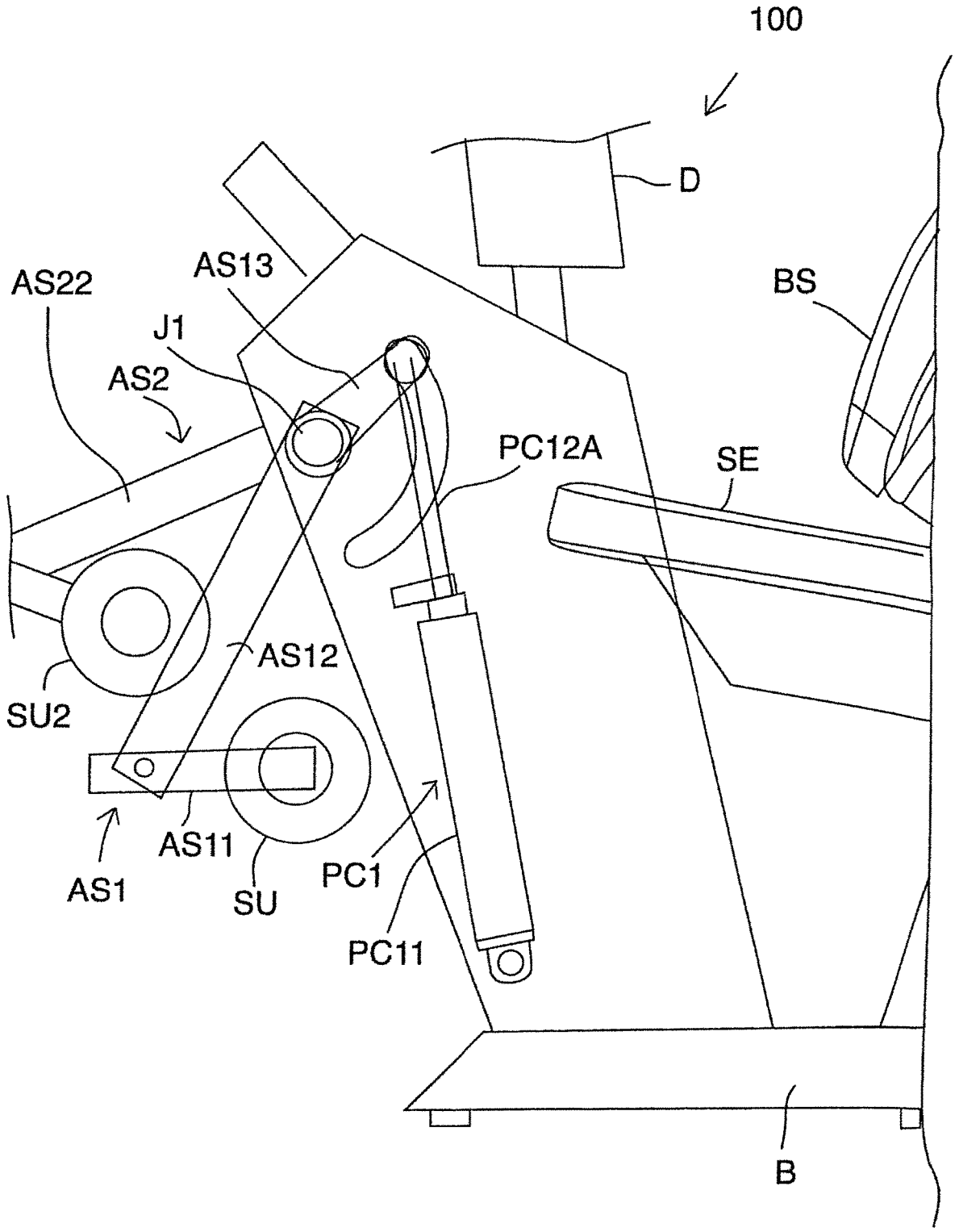
FIG. 1 is a view from the left of an apparatus for extending/bending a knee.
Figure 2:
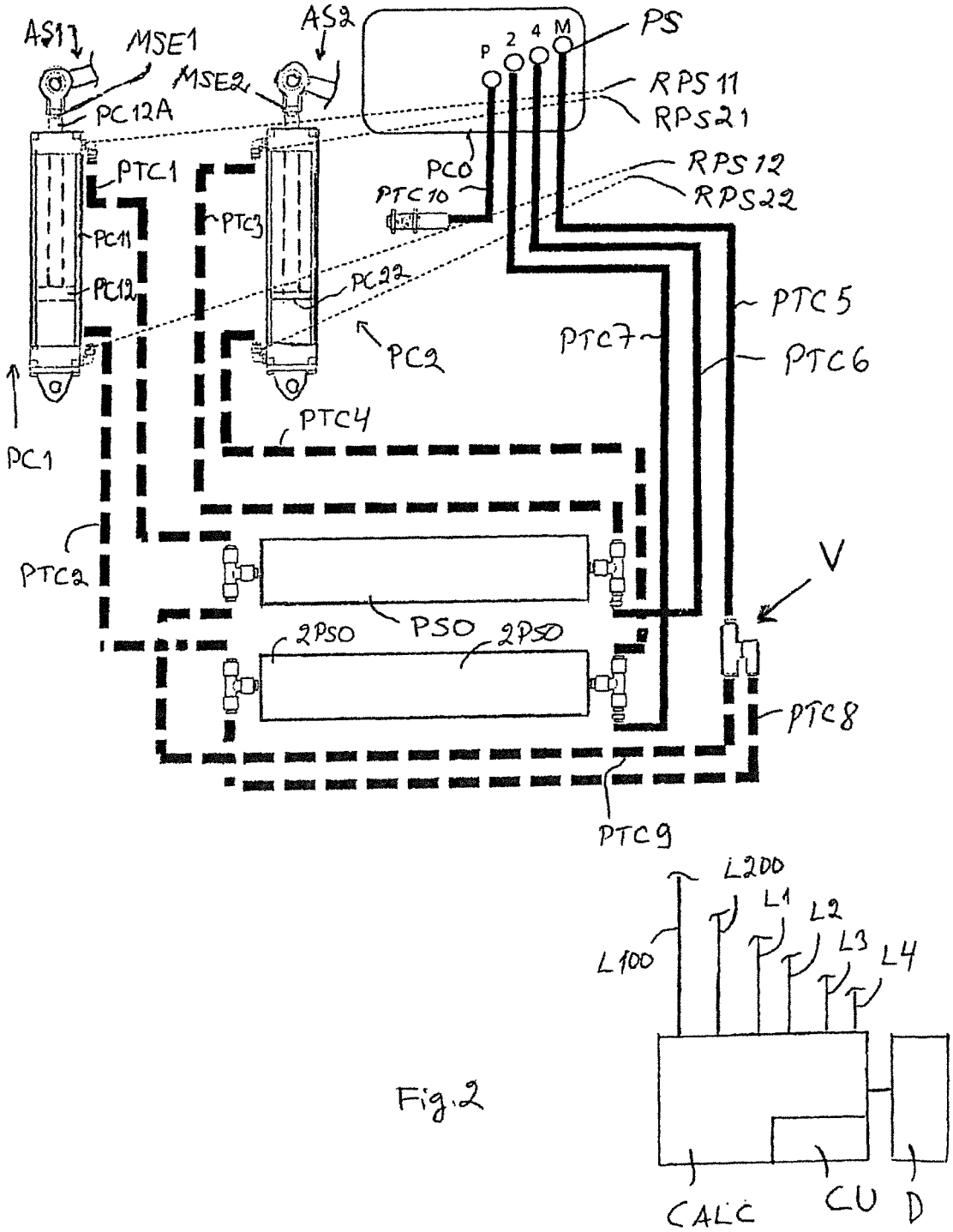
FIG. 2 shows a pneumatics diagram of a 2-cylinder extending/bending apparatus with other structures.

At first, referring to FIGS. 1 to 2, an apparatus 100 is examined, which is intended for forming physical stress, that is, an apparatus for an exercise task, the apparatus in FIGS. 1 to 2 being, by way of example, an apparatus for extending and bending a knee. The apparatus may be intended for keeping fit or for rehabilitation. The apparatus may be used to strain and tone up extensor muscles and flexor muscles. An apparatus in which the invention may be applied is, for example, a HUR 5530 manufactured by Hur Oy.

Figure 3:
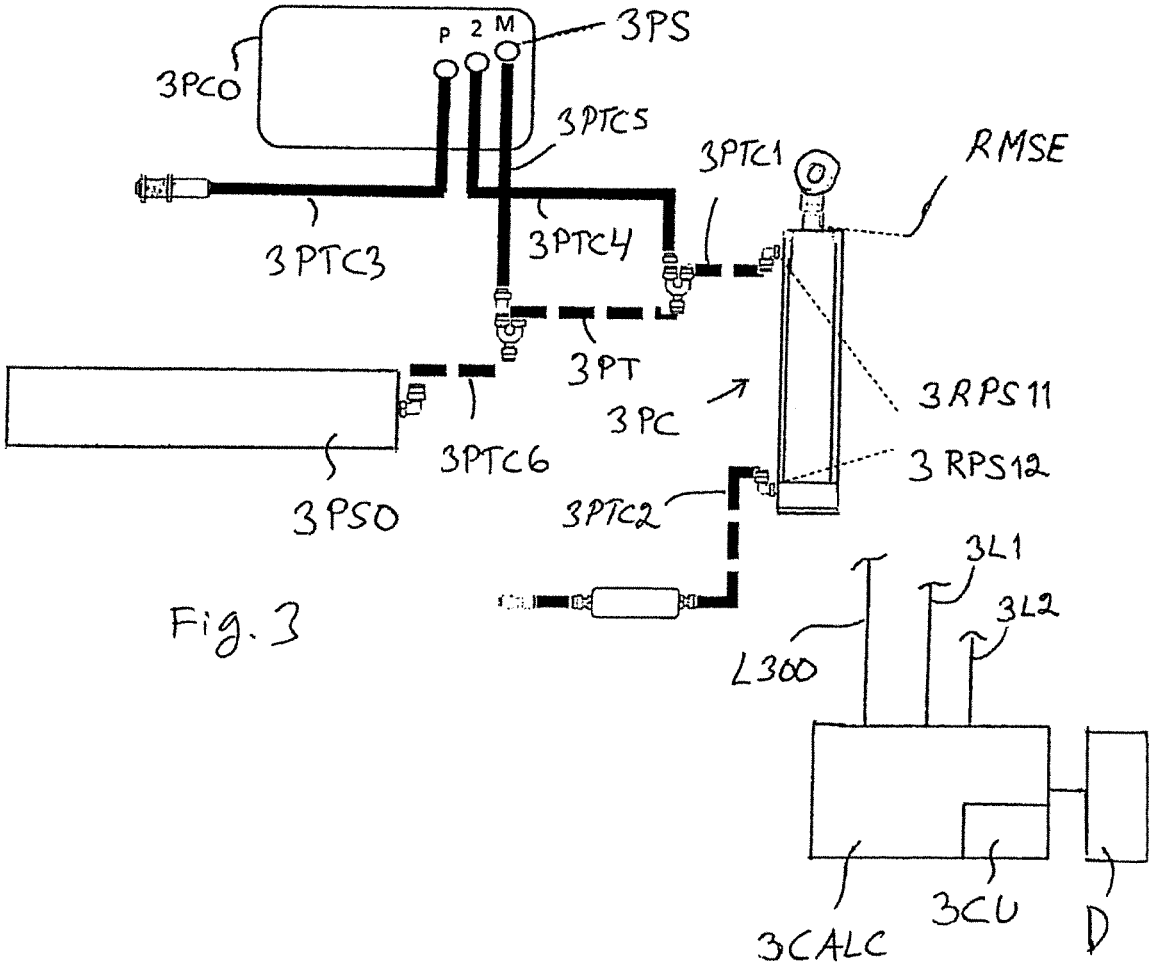
FIG. 3 shows a pneumatics diagram of a 1-cylinder pulley apparatus with other structures.

The apparatus may have one or more pneumatic resistors, the apparatus of FIGS. 1 to 2, 5 to 6 has two pneumatic resistors, the pneumatics diagram shown in FIG. 3 is a pneumatics diagram for an apparatus implemented with one pneumatic resistor.

Figure 5:
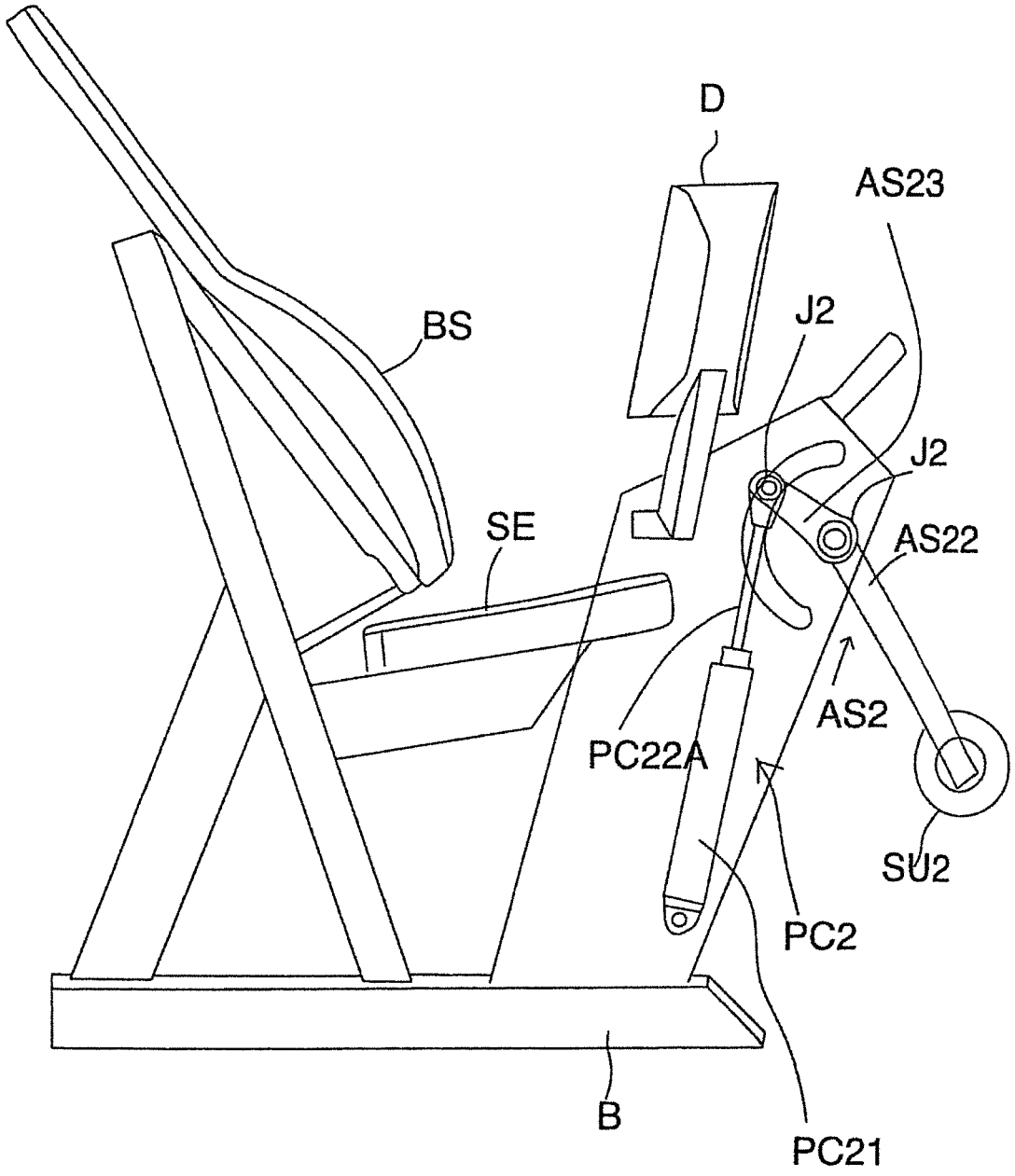
FIG. 5 is a view from the right of an apparatus for extending/bending a knee.
Figure 6:
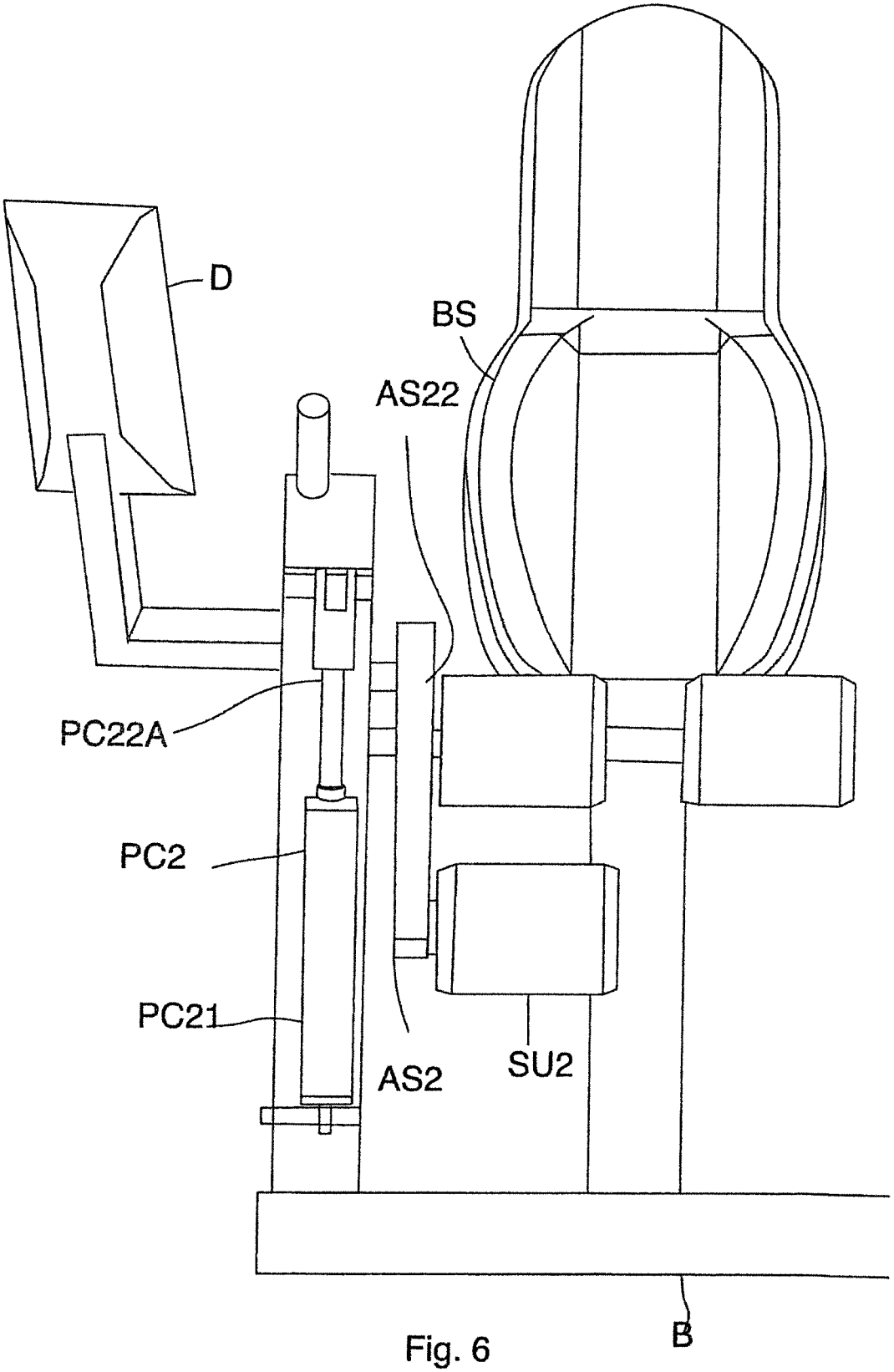
FIG. 6 is a front view of the apparatus, showing in particular the right side of the apparatus, which in FIG. 6 is on the left.

The apparatus of FIGS. 1 to 2, 5 to 6 comprises two pneumatic resistors PC1, PC2, of which only the first one, PC1, is seen in FIG. 1, because the corresponding symmetric structural parts (which are in FIGS. 5 to 6) on the other edge of the apparatus (the right side as seen from the user's direction, which in FIG. 6 is on the left, because FIG. 6 is from the front and not from the user's direction) are hidden behind the structural parts shown in FIG. 1, because FIG. 1 shows the left side of the apparatus as seen from the user's direction, although the left edge of FIG. 1 also shows an arm structure AS2 and roll SU2 on the right side of the apparatus.

In FIGS. 1 to 2, the pneumatic resistor PC1 comprises a pneumatic cylinder PC11 and a piston PC12 with a rod, correspondingly the second pneumatic resistor PC2 according to FIG. 2 and FIGS. 5 to 6 comprises a pneumatic cylinder PC21 and a piston PC22 with a rod (FIG. 2).

In addition, the apparatus comprises a mechanical lever arm structure such as AS1 for each of the pneumatic resistors. The mechanical lever arm structure or similar connecting structure is for a user's limb contact such as for a foot. The lever arm structure such as AS1 is at one end connected to a pneumatic resistor element PC1, in practice to a piston rod PC12A of the pneumatic resistor element PC1. This way the pneumatic resistor such as PC1 is able to resist a motion performed by a user. The lever arm structure AS1 comprises outer arms AS11 and AS12, a joint J1 and an inner arm AS13, this inner arm AS13 is connected to the piston rod PC12A of the pneumatic cylinder.

At the outer end of the lever arm structure AS1, that is, against a user's leg, there is at the end of the outermost lever arm AS11 a roll-like support member SU by means of which the user uses the lever arm structure AS1 against the resistance produced by the pneumatic resistor PC1. FIG. 1 also shows a seat SE and a back support BS for a user. The base of the apparatus is denoted by B.

With reference to FIG. 2, the apparatus comprises a pneumatic controller PCO, which is a valve structure, for example. The apparatus additionally comprises a pressure source PSO for delivering pressurised air to the pneumatic resistors PC1, PC2, controlled by the pneumatic controller. Furthermore, the apparatus comprises pneumatic transfer channels PTC1-PTC10 to interconnect the pneumatic resistors PC1, PC2, the pneumatic controller PCO, and the pressure source PSO.

The pressure source PSO may be, for example, a pressure accumulator i.e. a tank, pressurised by means of an external compressor through the transfer channel PTC10, and channel P of the pneumatic controller PCO and the transfer channel PTC6. A second tank is denoted by 2PSO.

The pneumatic resistors PC1, PC2, pneumatic controller PCO, pneumatic transfer channels PTC1-PTC10 and pressure source PSO, 2PSO are included in the pneumatic arrangement, that is, the pneumatic system in the apparatus.

The single pressure sensor PS of the pneumatic arrangement of the apparatus is provided in connection with the pneumatic controller PCO. The pneumatic controller PCO is arranged to provide a system pressure to the closed-circuit pneumatic arrangement. The single pressure sensor PS is arranged to measure a pressure change, which is arranged to be formed by the lever arm structure AS1, AS2 through the pneumatic resistor elements PC1, PC2. The system pressure is set before a workout is started. There is no active pressure adjustment during the workout, unlike in prior art apparatuses, but the pressure varies dynamically. The mechanical lever arms AS1, AS2 are responsible for the external resistance being natural for the human musculature over its entire range of motion.

In the version of FIGS. 1-2, the apparatus comprises at least two pneumatic resistor elements PC1, PC2. The sensor structure in such a case comprises, in addition to the single pressure sensor PS, motion sensors MSE1, MSE2 for the pneumatic resistor elements PC1, PC2. Each motion sensor, such as MSE1, is arranged to measure the movement of the piston rod of the pneumatic resistor element, such as that of the piston rod PC12A of the resistor element PC1, but the motion measurement may alternatively reside in the joints J1, J2 of the articulated arm structure AS1, AS2 as discussed below.

The apparatus also comprises a calculation arrangement CALC and a display D. The sensor structure PS, MSE1, MSE2 is arranged to measure at least one measurement quantity of the exercise task, and based on the measurement the calculation arrangement CALC is arranged to form information on the display D of the apparatus, regarding the power and/or force and/or range of motion of the exercise task. The calculation arrangement CALC is implemented by means of a programmable processor, for example. The display D may be connected to other structural parts of the apparatus, specifically with the calculation arrangement CALC, either by wires or wirelessly.

Regardless of the number of pneumatic resistor elements, the sensor structure comprises one pressure sensor PS, only. To compensate for the small number of sensors, the calculation arrangement CALC comprises a correlation-taught calculation unit CU which includes a correlation algorithm taught with a larger number of sensors at the reference measurement stage than the number of sensors in the apparatus, concerning the correlation between the power and/or force and/or range of motion of the exercise task and the measured information.

In the final apparatus ready to be used, the only pressure sensor PS resides in the pneumatic controller PCO. The pressure sensor PS measures the pressure of the closed system, that is, the pressure sensor PS measures a change in the pressure of the system, the change always being one in the work direction. Therefore, it is not essential which side of the cylinder (the portion on the face side of the piston, the portion on the piston rod side) is pressurised.

In an embodiment, the single pressure sensor PS of the pneumatic arrangement is arranged to measure pressure on the side of the pneumatic cylinder, such as PC1, which is connected to the mechanical lever arm structure AS1. But because the apparatus may alternative be double-acting, that is, using different resistor elements PC1, PC2 with e.g. feet at a different pace, either side (piston rod side or piston face side) of the resistor element, so the pneumatic cylinder, such as PC1, may be pressurised, which means that the pressure measurement with the sensor PS in the measurement channel M (pneumatic line PTC5) does not always take place as in FIG. 2 (and FIG. 3), so on the side of the piston where the lever arms AS1 are connected. Therefore, it is also possible that the single pressure sensor PS is arranged to measure pressure on the side of the piston, such as PC12, of the pneumatic cylinder, such as PC1, which side is between the piston face and the cylinder, such as PC11.

By means of the pressure sensor PS in connection with the pneumatic controller PCO and with the taught calculation algorithm of the calculation unit CU, it is possible in the final apparatus to be brought into use to eliminate, that is, compensate for the measurement needs of all the pressurised cylinder sides (on the face side of the piston or on the piston rod side), which means that the pressure sensors RPS11-RPS12, RPS21-RPS22, referred to below, used in the reference measurement, are not needed. The pressures on the unpressurised sides of the cylinders are also taken into account by the taught calculation algorithm of the calculation unit CU, said calculation algorithm not being dependent on the pressure measured in the pneumatic controller PCO.

Regardless of the number of pneumatic cylinders in the apparatus, the apparatus has one pressure sensor PS, only, which as stated in the above resides in the pneumatic controller PCO. This single pressure sensor PS is connected to the calculation unit CALC by a transfer link such as transfer line L100 to provide the calculation arrangement CALC with pressure information. In a 2-cylinder apparatus according to FIGS. 1 to 2, 5 to 6, the motion sensors MSE1, MSE2 (or a structural part, such as a camera, reading/measuring them) is connected by a transfer link, such as a transfer line L200, to the calculation arrangement CALC to provide the calculation arrangement CALC with motion measurement information. In an embodiment, motion measurement is optical. In an embodiment, motion measurement may take place by sensors in connection with joints J1, J2 of the articulated arm structures AS1, AS2, because the rotation movement of the joint is slower than the linear movement of the piston rod, resulting in a more precise motion measurement.

Insofar as the knee extension/bending apparatus shown in FIGS. 1 to 2, 5 to 6 is concerned, it may be noted that when a user wishes to extend his knee i.e. extend his leg or raise his leg and feet upward, the user places his foot under the roll SU (correspondingly SU2) and the user or e.g. a fitness trainer selects on the user interface (display device D with a touchscreen) a selection which activates channel 2 on the pneumatic controller PCO, whereby pneumatic pressure through the tank 2PSO is obtained on the side of the pistons of the pneumatic resistor elements PC1, PC2 (under the pistons in FIG. 2) by means of the channels PTC7, PTC2, PTC4 to resist the extension of the leg.

When a user wishes to bend his knee i.e. lower his leg and feet, the user places his heel on the roll SU (correspondingly SU2) and the user or e.g. a fitness trainer selects on the user interface (display device D with a touchscreen) a selection which activates channel 4 on the pneumatic controller PCO, whereby pneumatic pressure through the tank PSO is obtained on the side of the piston rods of the pneumatic resistor elements PC1, PC2 (over the pistons in FIG. 2) by means of the channels PTC6, PTC1, PTC3 resist the bending of the leg.

Measuring the pneumatic pressure takes place with the pressure sensor PS from the measurement channel M (pneumatic line PTC5) in connection with the pneumatic controller PCO. The pressure sensor PS is connected to the calculation unit CALC on a transfer link or transfer line L100 to provide the calculation arrangement CALC with the pressure information. Pressure measurement is an active process which is running in the background during normal operation of the apparatus. By means of the invention, this measurement process is made use of during the measurement and analysis of an exercise task. With reference to FIG. 2, it is noted that a structural part V is an automatically operating selector valve V, on the input side of which is connected a pneumatic channel/line PTC9 (which is coupled to the tank PSO and channel/line PTC1), and a pneumatic channel/line PTC8 (coupled to the tank 2PSO and channel/line PTC2). The input of the valve V (the bottom side of the valve V in FIG. 2) opens on the side (PTC9 or PTC8) that has the higher pressure, connecting either the channel PTC9 or PTC8 to the measurement channel M, PTC5 on the output side of the valve (the top side of the valve V in FIG. 2). If the valve V is considered a logical element, it is an OR-gate. The valve V also automatically closes on the input side the channel (PTC8 or PTC9) that has no pressure. Thus, the valve V is not actively controlled but it opens automatically to the side (PTC9 or PTC8) which is pressurised based on the exercise mode, the exercise mode in turn is selected on the display unit D (touchscreen) and activated by a the controller PCO which is, for example, a group of valves (valve box). As concerns FIGS. 2 to 3, it is noted for reasons of clarity that the presentation by dotted lines for some channels/lines only relates to the fact that the channels/lines in question are pressurised hoses or other similar channels/lines with a different thickness than those drawn with a solid line.

Next, as concerns FIG. 2, additional structural parts are discussed, which were used at the teaching stage of the apparatus, in other words when the correlation algorithm was formed for the calculation unit CU by means of reference measurements. These additional structural parts are removed from the final apparatus to be for sale and for use. The most essential additional structural parts used at the reference measurement stage are pressure sensors RPS11-RPS12 of the pneumatic resistor elements (for the pneumatic resistor PC1) and RPS21-RPS22 (for the pneumatic resistor element PC2).

In the above, power relates to pneumatic power. In an embodiment, the external lever arms may have a motion sensor such as an acceleration sensor or a gyroscope, which may be used together with power sensors attached to the lever arms to model mechanical force and mechanical power.

As relates to pneumatic power, it may be noted that the derivative of power represents the speed of motion which is the most significant factor of power. The derivative of pressure also represents a naturally aspirated counter-pressure through a limiter of a cylinder i.e. pneumatic resistance. The derivative of pressure is calculated with the pressure sensor PS in a production apparatus in the teaching of the calculation model (as an input) and in the final product, that is, the user apparatus. The correlation between power P, force F, and speed of motion v is defined by the formula: $P=F\times v$, where "x" is the operator of multi-plication. Force F mainly corresponds to pressure, and the derivative of pressure corresponds to the speed of motion.

The pressure sensors RPS11-RPS12 at the reference measurement stage (for the pneumatic resistor element PC1) and RPS21-RPS22 (for the pneumatic resistor element PC2) are connected to the calculation arrangement CALC through the transfer links L1-L4. The transfer links L1-L4 are also removed from the apparatus because they are not used in the final apparatus.

By means of the reference measurements by, for example, the MATLAB simulation program, correlation is sought between the measurements provided by the sensors used in the reference measurement and the information (power and/or force and/or range of motion) to be presented on the display to the user, which is then stored as an algorithm in the calculation unit CU comprised by the calculation arrangement. This way, it is possible to model variables of, for example, power or alternatively those of the missing sensors, which variables may be used in calculating power, this way power is reached directly or through intermediate steps.

In FIGS. 5 to 6, on the other side of the apparatus (on the right side from the user's direction, left in FIG. 6) there are structural parts, which are of the same type as those disclosed for FIG. 1. FIGS. 5 to 6 show a second pneumatic resistor element PC2, a second mechanical lever arm structure AS2. The lever arm structure AS2 comprises an outer arm AS22, a joint J2, and an inner arm AS23, the inner arm AS23 being fixed to the piston rod PC22A of the pneumatic cylinder. The seat SE, seat support BS, and base B of the apparatus are the same as in FIG. 1.

Figure 4:
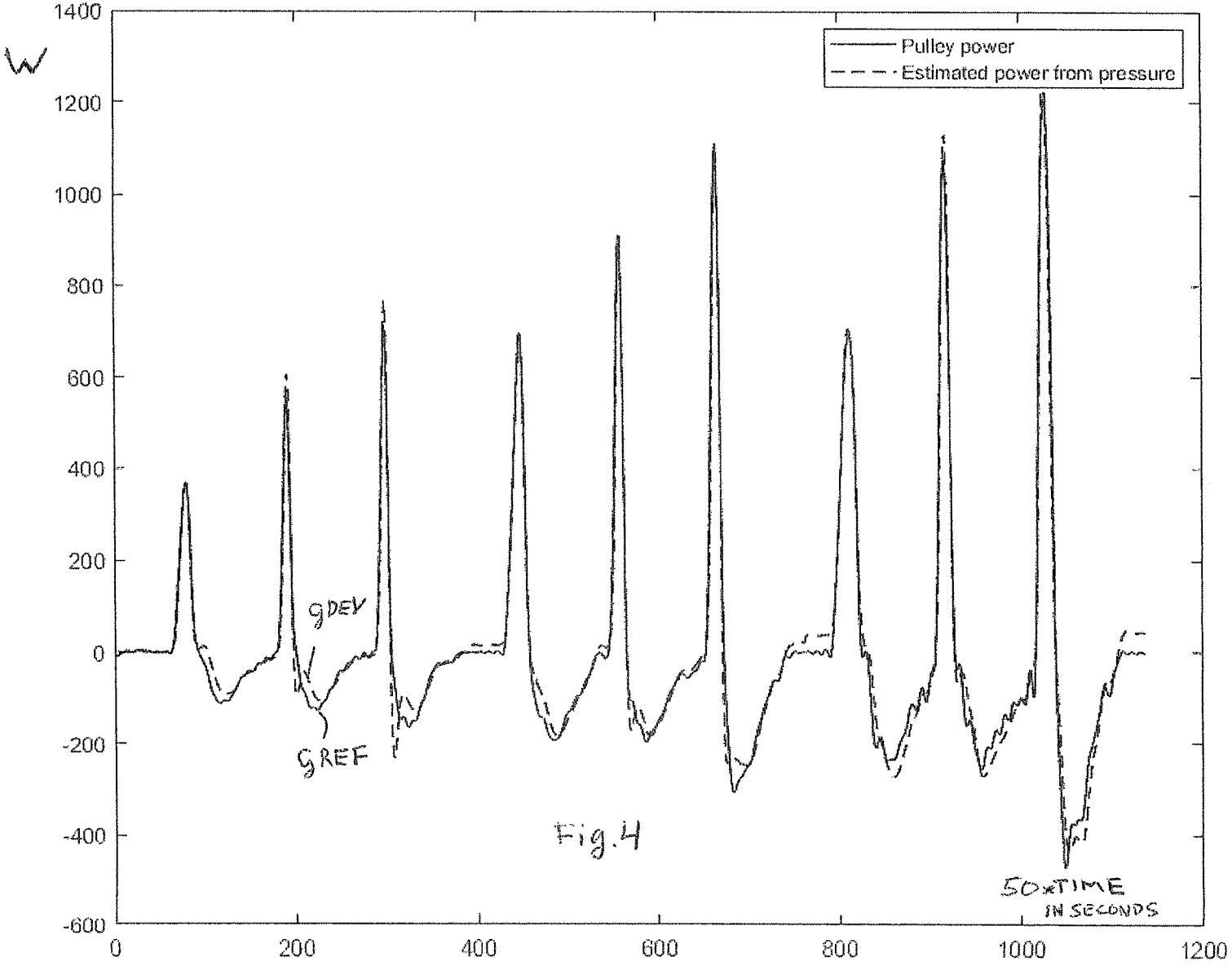
FIG. 4 is a power diagram, showing power established with laboratory reference measurements, and power computed with a final apparatus according to the invention.

FIG. 4 shows a power diagram, showing a power diagram GREF for an apparatus with additional sensors used in laboratory reference measurements, the power diagram GDEV is the for the final apparatus according to the invention, which has fewer sensors. It is discovered that the power diagrams GREF and GDEV very closely resemble each other, which proves that the invention is working. In FIG. 4, the vertical axis i.e. the Y axis represents power as watts (W), although it is worth mentioning that numerical values below the value 0 on the vertical axis relate to motion in another direction that positive values of power W, that is, positive/negative indicates the direction of motion in power. The positive is a concentric direction of motion, the negative is an eccentric direction of motion. The horizontal axis i.e. the X axis represents the course of time by measurement points as seconds but multiplied by the sampling frequency 50, so the value of 200, for example, means four seconds.

FIG. 3 shows a pneumatic diagram of a 1-cylinder fitness apparatus, such as a pulley. The same structures for the most part may be seen in FIG. 3 as in FIG. 2, but because FIG. 3 relates to an apparatus implemented with one pneumatic resistor element 3PC, the resistor element 3PC does not need a motion sensor. This being the case, a calculation unit 3CU provided with a taught correlation algorithm needs measurement information provided by a single pressure sensor 3PS through the transfer link L300. In addition, the apparatus comprises pneumatic transfer channels 3PTC1-3PTC6 to interconnect the pneumatic resistor 3PC, pneumatic controller 3PCO, and pressure source 3PSO. In addition, the apparatus comprises a calculation arrangement 3CALC having the aforementioned calculation unit 3CU. In FIG. 3, the additional pressure sensors used at the reference measurement stage and removed from the final apparatus are denoted by 3RPS11, 3RPS12. The pressure sensors 3RPS11, 3RPS12 of the reference measurement stage are connected to the calculation arrangement CALC through transfer links 3L1, 3L2. These transfer links 3L1, 3L2 are also removed from the apparatus, because they are not needed in the final apparatus in use.

Those skilled in the art will find it obvious that, as technology advances, the basic idea of the invention may be implemented in many different ways. The invention and its embodiments are thus not restricted to the above-described examples but may vary within the scope of the claims.

What is claimed is:

1. An apparatus for an exercise task comprising:

a closed-circuit pneumatic arrangement which comprises a pressure source, a pneumatic controller, pneumatic transfer channels, and at least one pneumatic resistor element which comprises a pneumatic cylinder and a piston with a rod;

at least one mechanical lever arm structure which is for a user's limb contact, the at least one mechanical lever arm structure having a first end and a second end, the second end being connected to the at least one pneumatic resistor element;

a sensor structure;

a calculation arrangement; and a display, the sensor structure being arranged to measure at least one measurement quantity of the exercise task and, based on the at least one measurement quantity the calculation arrangement, is arranged to form information on the display of the apparatus, regarding power and/or force and/or range of motion of the exercise task, wherein, regardless of the number of pneumatic resistor elements, the sensor structure comprises a single pressure sensor, only, and to compensate for the small number of pressure sensors, the calculation arrangement comprises a correlation-taught calculation unit which includes a correlation algorithm taught with a larger number of pressure sensors, concerning correlation between power and/or force and/or range of motion of the exercise task and measurement quantities.

2. The apparatus as claimed in claim 1, wherein the apparatus comprises at least two pneumatic resistor elements and, in such a case, the sensor structure comprises, in addition to the single pressure sensor, motion sensors for the at least two pneumatic resistor elements.

3. The apparatus as claimed in claim 2, wherein each motion sensor is arranged to measure movement of the rod of each of the at least two pneumatic resistor elements.

4. The apparatus as claimed in claim 1, wherein the single pressure sensor is arranged to measure pressure on rod-side of the pneumatic cylinder, which is connected to the second end of the at least one mechanical lever arm structure.

5. The apparatus as claimed in claim 1, wherein the single pressure sensor is arranged to measure pressure on piston-side of the pneumatic cylinder, which is between a face of the piston and end of the pneumatic cylinder.

6. The apparatus as claimed in claim 1, wherein the single pressure sensor is in connection with the pneumatic controller.

7. The apparatus as claimed in claim 1, wherein the pneumatic controller is arranged to provide a system pressure to the closed-circuit pneumatic arrangement, and the single pressure sensor is arranged to measure a pressure change.

* * * * *